US007857312B2

(12) United States Patent
Benedek et al.

(10) Patent No.: US 7,857,312 B2
(45) Date of Patent: Dec. 28, 2010

(54) KNIGHT-WALK PUZZLE GAME

(76) Inventors: Gyora Mihaly Pal Benedek, 14 Ha-alonim St., Kiryat Bialik (IL) 27212; Shai Seger, 22 Mizpe, Haifa (IL) 32682

( * ) Notice: Subject to any disclaimer, the term of this patent is extended or adjusted under 35 U.S.C. 154(b) by 0 days.

(21) Appl. No.: 12/642,878

(22) Filed: Dec. 21, 2009

(65) Prior Publication Data

US 2010/0096804 A1 Apr. 22, 2010

Related U.S. Application Data

(63) Continuation of application No. 11/692,940, filed on Mar. 29, 2007, now abandoned.

(60) Provisional application No. 60/768,797, filed on Mar. 29, 2006.

(51) Int. Cl.
*A63F 3/00* (2006.01)

(52) U.S. Cl. ..... 273/153 R; 273/275; 273/261

(58) Field of Classification Search ..... 273/153 R, 273/260, 261, 275, 241
See application file for complete search history.

(56) References Cited

U.S. PATENT DOCUMENTS 6,460,855 B2 * 10/2002 Shinderovsky ..... 273/272

* cited by examiner

*Primary Examiner*—Vishu K. Mendiratta
(74) *Attorney, Agent, or Firm*—Mark M. Friedman

(57) ABSTRACT

A puzzle game of the present invention consists of a field of play having associated positions upon which place-indicators are placed during game play along a predetermined game path. Placement of the place-indicators represents a sequential series of steps from a starting point along a game path in the field of play to an end point. Each of the steps is dependent on a predetermined step pattern and the place-indicator is placed on the position upon which the end of the step pattern falls. The solution to the puzzle is achieved by the placement of all place-indicators between the starting point and the end point. In order to indicate a particular game path, at least two place-indicators are pre-placed as givens in the solution. The place-indicators may be, by non-limiting example, numerals, letters or a group of shapes with a predetermined series displayed on the game play interface, but outside of the field of play.

6 Claims, 5 Drawing Sheets

2

| | | | | |
|---|---|---|---|---|
| | 18 | | | |
| | f | 22 | e | |
| g | a | h | 24 | d |
| | | b | | 16 |
| 1 | | | | c |

FIG. 1

2

| | | | | |
|---|---|---|---|---|
| 21 | 18 | 7 | 12 | 23 |
| 8 | 13 | 22 | 19 | 6 |
| 3 | 20 | 17 | 24 | 11 |
| 14 | 9 | 2 | 5 | 16 |
| 1 | 4 | 15 | 10 | 25 |

FIG. 2

KNIGHT-WALK PUZZLE GAME

This application is a Continuation of U.S. patent application Ser. No. 11/692,940 filed 29 Mar. 2007 claiming priority from U.S. Provisional Patent Application Ser. No. 60/768,797 filed on 29 Mar. 2006.

FIELD AND BACKGROUND OF THE INVENTION

The present invention relates to puzzle games and, in particular, it concerns a puzzle game in which the game field is filled by placing numerals in specific positions spaced apart one from another by a predetermined step pattern along a predetermined path in a grid.

Puzzle games in which squares on a grid are filled with numbers dictated by a solution are known in the art. One example of games in this genre is Sudoku, a logic-based number placement puzzle. The objective is to fill a 9×9 grid so that each column, each row, and each of the nine 3×3 boxes contains the digits from 1 to 9. The puzzle is provided with a partially completed grid. Other games include Latin Squares and Magic Squares.

There are no puzzles known in the art in which the solution follows a predetermined path along which there is a predetermined relationship between each step.

There is therefore a need for a puzzle game in which the game field is filled by placing numerals in specific positions spaced apart one from another by a predetermined step pattern along a predetermined path in a grid.

SUMMARY OF THE INVENTION

The present invention is a puzzle game in which the game field is filled by placing numerals in specific positions spaced apart one from another by a predetermined step pattern in a grid along a predetermined path According to the teachings of the present invention there is provided a method of forming and solving a puzzle game, the method comprising: (a) providing a field of play having associated positions upon which sequential place-indicators are placed during game play along a predetermined game path, an association of the associated positions being substantially any relationship between two the associated positions on the field of play, including non-horizontal and non-vertical relationships; (b) placing the place-indicators so as to represent a series of sequential steps from a starting point, along the game path, to an end point; wherein each step of the series of steps has a predetermined step pattern and each the place-indicator is placed on the field of play at an end of a respective the step of the series of steps and at least two the place-indicators are pre-placed as givens in the solution, and (c) solving the puzzle by the placement of all place-indicators on all empty squares between the starting point and the end point such that all associated positions within the field of play are included in the game path.

According to a further teaching of the present invention, a relationship between the associated positions on the field of play is implemented not as a grid.

According to a further teaching of the present invention, a relationship between the associated positions on the field of play is implemented such that the associated positions are non-contiguous.

According to a further teaching of the present invention, the step pattern is implemented as being similar to a move that can be made by a chess piece on a chessboard during a game of chess.

According to a further teaching of the present invention, there is also provided pre-placing one or more place-indicators its predetermined position along the game path by a game setter prior to a beginning of play.

According to a further teaching of the present invention, there is also provided configuring the game path such that there is a single solution to the puzzle along a given the game path between the starting point and end point that includes the one or more pre-placed place-indicators in proper sequence.

According to a further teaching of the present invention, there is also provided a computer program programmed to: (a) determine a size of the field of play; (b) determine the step pattern; (c) choose the starting point; (d) determine the game path; and (e) indicate positions of the at least two given place-indicators, as determined by a solution to the puzzle game, on a game play interface.

According to a further teaching of the present invention, the computer program provides a process for varying a level of difficulty of the puzzle game.

According to a further teaching of the present invention, the computer program generates a game play interface.

According to a further teaching of the present invention, the game play interface is implemented as printed material.

According to a further teaching of the present invention, the game play interface is implemented by being displayed on a display monitor.

BRIEF DESCRIPTION OF THE DRAWINGS

The invention is herein described, by way of example only, with reference to the accompanying drawings, wherein:

FIG. 1 is an example of a first preferred embodiment of a game play interface constructed according to the teachings of the present invention, shown here before game play has begun;

FIG. 2 is the game play interface of FIG. 1 after completion of the game;

DESCRIPTION OF THE PREFERRED EMBODIMENTS

Figure 3:
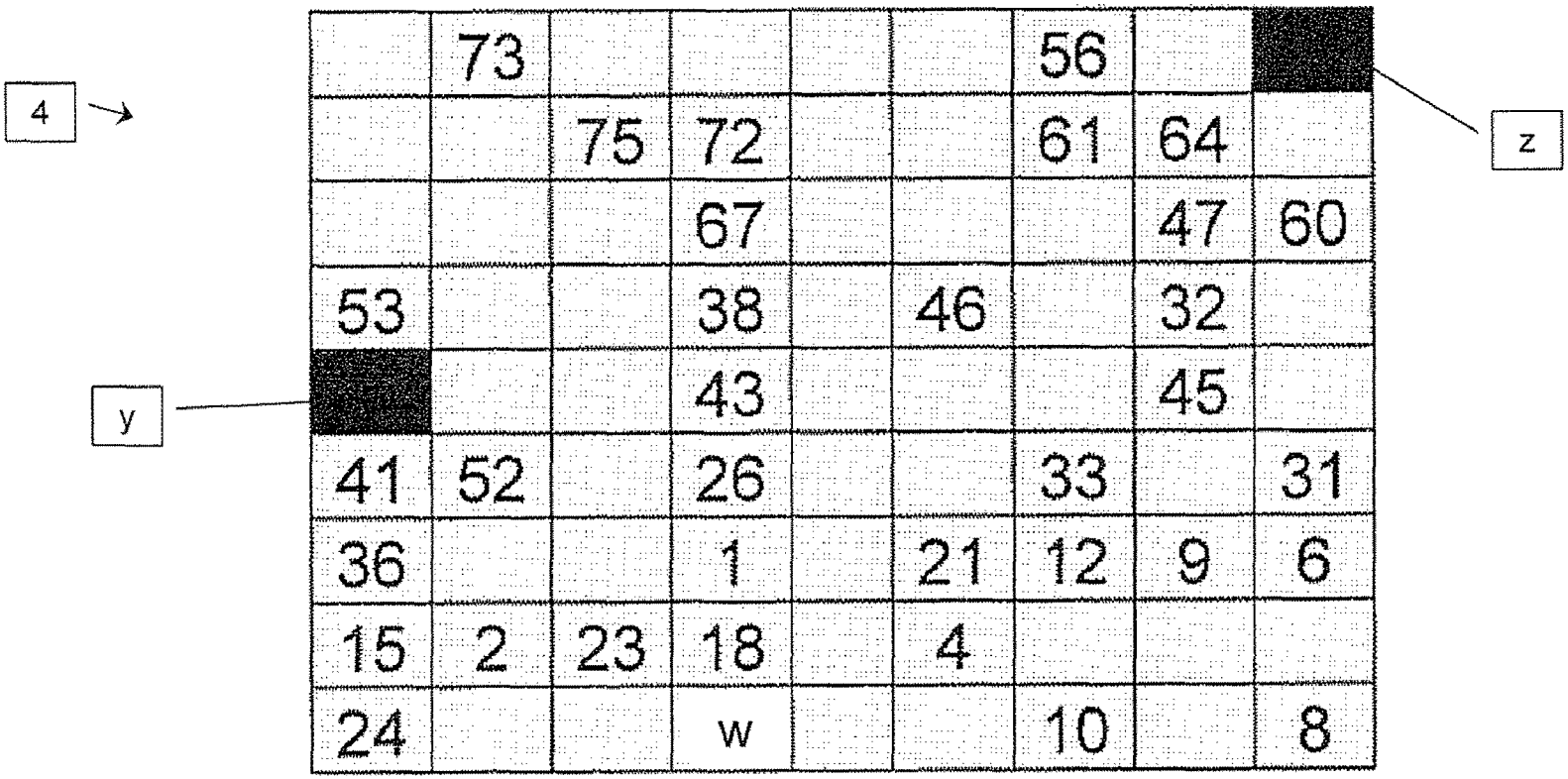
FIG. 3 is an example of a more complex variation of the game play interface of FIG. 1, shown here before game play has begun.

The present invention is a puzzle game in which the game field is filled by placing numerals in specific positions spaced apart one from another by a predetermined step pattern along a predetermined path in a grid.

The principles and operation of a puzzle game according to the present invention may be better understood with reference to the drawings and the accompanying description.

By way of introduction, the puzzle game of the present invention consists of a field of play having associated positions upon which place-indicators are placed during game play along a predetermined game path. Placement of the place-indicators represents a sequential series of steps from a starting point along a game path in the field of play to an end point. Each of the steps is dependent on a predetermined step pattern and the place-indicator is placed on the position upon which the end of the step pattern falls. The solution to the puzzle is achieved by the placement of all place-indicators between the starting point and the end point. In order to indicate a particular game path, at least two place-indicators are pre-placed as givens in the solution. That is to say, at least two given place-indicators are pre-placed by the puzzle setter. The place-indicators may be, by non-limiting example, numerals, letters or a group of shapes with a predetermined series displayed on the game play interface, but outside of the field of play.

In a preferred embodiment of the puzzle game of the present invention, the field of play is a grid of squares such that some of the squares represent the associated positions in the field of play. Some of the squares are empty and are included in the field of play. Other squares may be excluded from the field of play. These squares may be noticeably indicated as blocked from play by, for example, being completely colored in. Alternately, squares excluded from the field of play may be left empty so as to appear to the player as being included in the field of play. Therefore, it will be up to the player to eliminate such squares from the field of play as part of finding the solution to the puzzle. Other squares that are included in the field of play contain a numeral as a given in the solution of the puzzle.

The solution to the puzzle of the present invention follows a predetermined path along which there is a predetermined relationship between each step. To solve the puzzle the player must fill all empty squares such that the numerals represent the sequence of steps having a predetermined pattern, beginning at the square with the numeral 1 and continuing in numerical sequence until the entire field of play is filled while continuing the same step pattern. It should be noted that the predetermined step pattern may be substantially any relationship between two squares on the grid such as, but not limited to, one square vertically or one square horizontally, one square vertically, horizontally or diagonally, three squares horizontally and one vertically or three vertically and one horizontally, and four squares either horizontally, vertically or diagonally. It will be readily understood that the number of step patterns is limited only by the size of the field of play and the imagination of the game setter. It should be noted that the terms "step" and "move" may be used interchangeably herein and both terms refer to movement according to the predetermined step pattern along the solution path of the puzzle.

Figure 5:
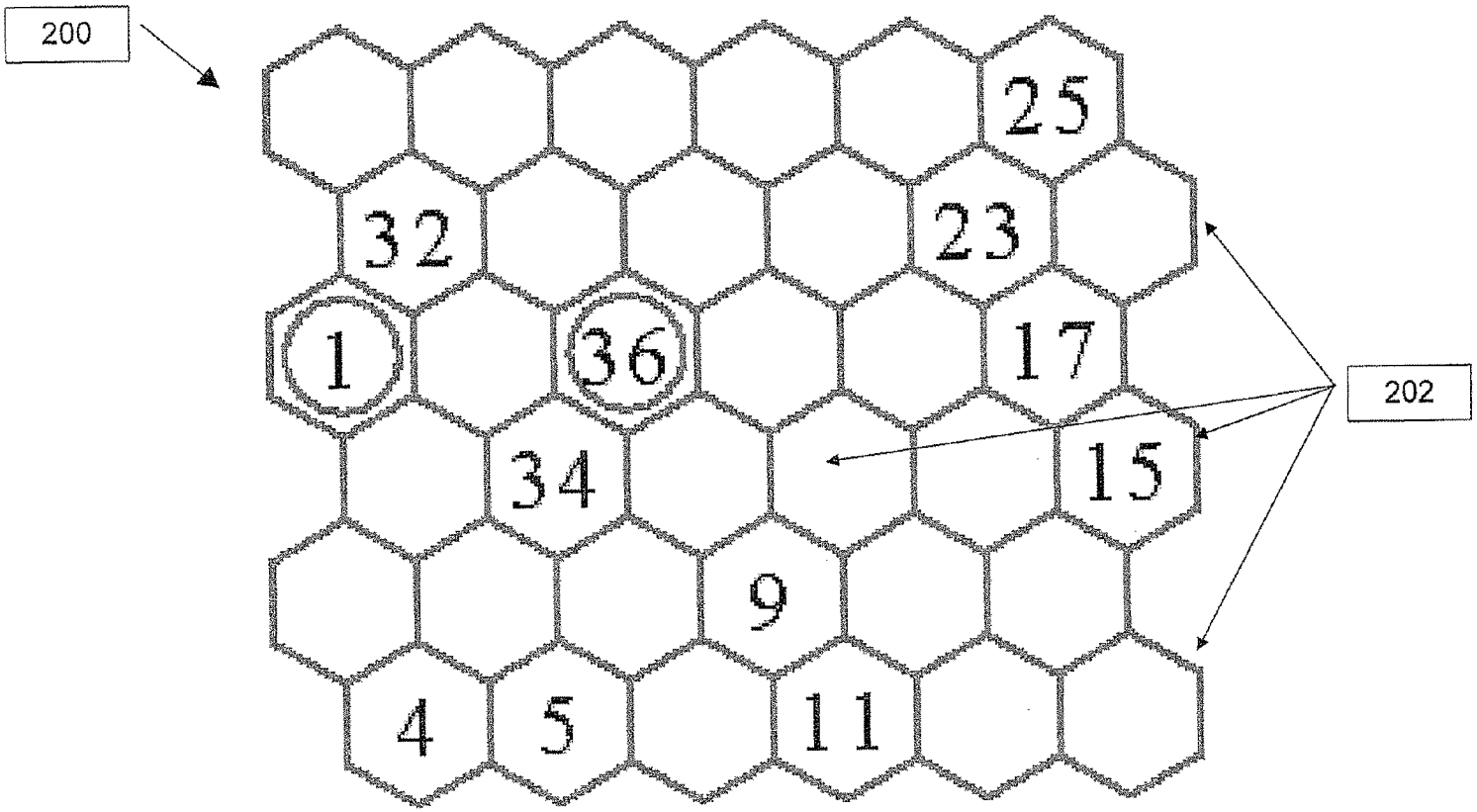
FIG. 5 is a second preferred embodiment of a game play interface constructed according to the teachings of the present invention, shown here before game play has begun.
Figure 6:
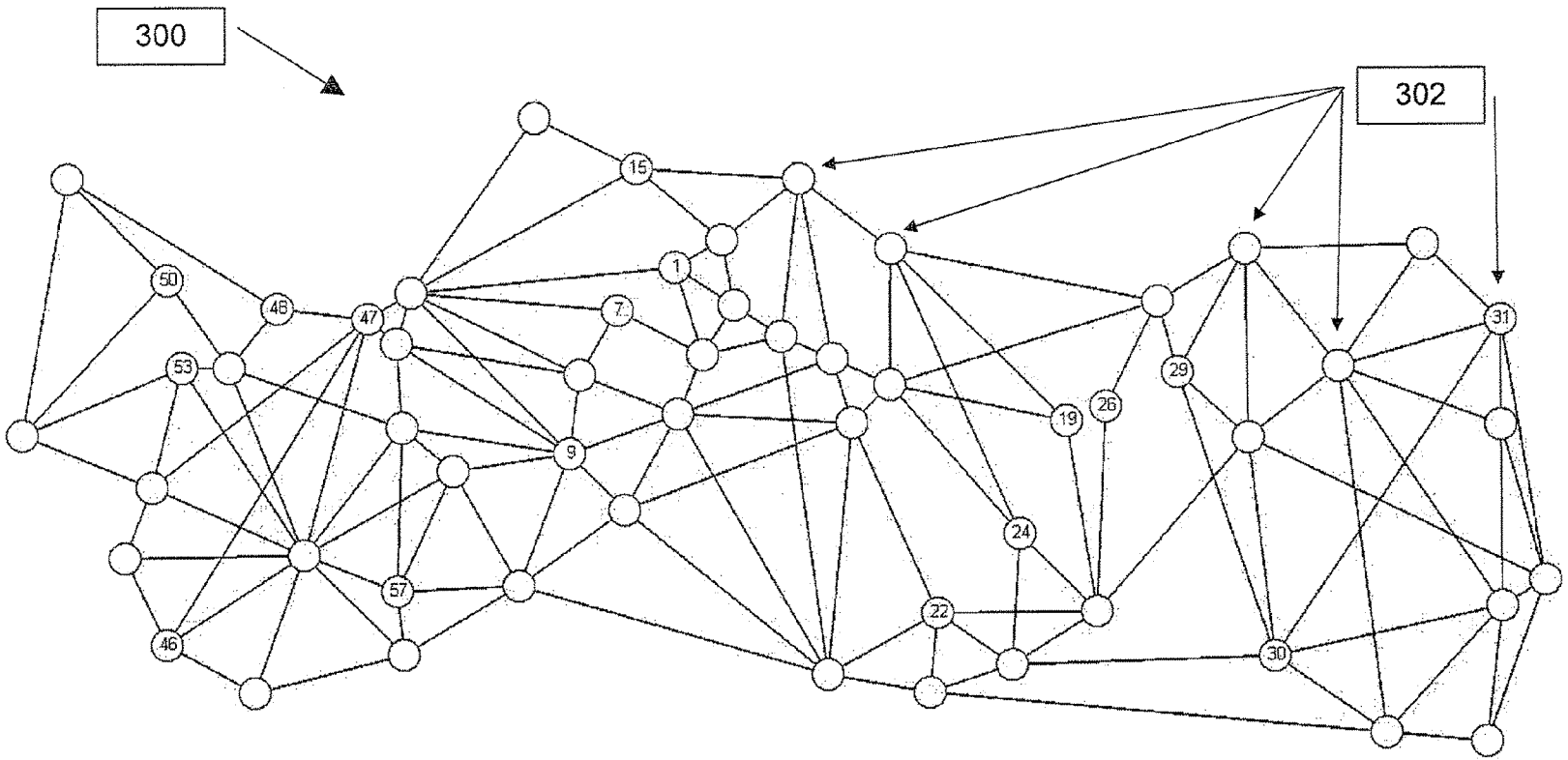
FIG. 6 is a third preferred embodiment of a game play interface constructed according to the teachings of the present invention, shown here before game play has begun.

It should be noted that the use of the term "grid", which usually connotes substantially horizontal and vertical lines, and the term "square(s)" are used herein as non-limiting examples only and that the relationship between places on the field of play upon which numerals are to be placed need not be limited to a grid per se, as illustrated in FIGS. 5 and 6. That is to say, the outer contour of the field of play need not be square or rectangular, but may take any shape such as, but not limited to, circles and other closed curves, and the outer contour of animate and inanimate objects such as, but not limited to, toys, vehicles, plants and animals. Further, the shape of the place on the field of play upon which numerals are placed is not to be limited by the term "square(s)," as used herein, the term "square(s)" is intended to include substantially all representations of a point or substantially any non-rectangular shape such as, but not limited to, triangles, pentagons, hexagons (see FIG. 5) and circles (see FIG. 5) and other closed curves, as well as squares and rectangles.

In the non-limiting preferred embodiment of the puzzle game of the present invention described herein, the field of play is indeed a square or a rectangle having a grid of squares similar to a chessboard, and the predetermined pattern of the steps is similar to that of a knight during a chess game. That is, a step of two squares horizontally and one vertically or two vertically and one horizontally. The numeral indicating a particular step number in the sequence is placed on the last square in the step pattern. The path along which the "knight" moves, starts at square number 1, then moves to square number 2, and so on in numerical sequence until the field of play is filled with numerals indicating each step taken. It should be noted that in a test version of the game, variant step patterns similar to the moves taken by the King and Rook were included.

It is preferable that a puzzle should have a single solution and that the solution should not require trial-and-error or backtracking. Rather that the solution may be found by logic.

It will be appreciated that puzzles may be of various levels of difficulty from very easy to very hard. Further, the size of the field of play may be varied independent of, or in conjunction with, the difficulty level. That is, board sizes (the number of squares on the grid) and shapes may vary. For example 5 squares by 5 squares, 5 squares by 7 squares, 10 squares by 10 squares or any other sizes for a rectangular board. Variation of size and level may also be provided for puzzle having non-rectangular outer contours, as mentioned above.

Additional rules may include restrictions that limit moves or steps along the path such as, but not limited to, a step may not jump over filled squares.

It will be appreciated that the field of play may be represented by a game play interface in a variety of ways such as, but not-limited to, printed material and electronic displays. When the game play interface is printed material, the puzzle may be solved using a writing utensil such as a pen or pencil for example. When the game play interface is electronic, the puzzle is depicted on the electronic display of such devices as, but not limited to, personal computers both desktop and laptop, game consoles, cellular phones, PDAs, TV set, and hand-held electronic game platforms such as GameBoy™. When thusly displayed, the puzzle may be solved using standard input devices such as, but not limited to, keyboards, a mouse, game pads, joysticks and touch screens.

When the game is displayed electronically, a computer program controls the display, input and logic. The computer program can also store various pre-made puzzles and or create new ones. The computer program may also be configured to provide help to the player upon request by giving hints such as, but not limited to:

1. Showing all valid moves from a particular square.
2. The location of a particular number already marked on the board.
3. The status of each number.
4. A partial or full solution of the puzzle.
5. Warnings in case the player has made an error of some kind.
6. Hints such as, but not limited to, the next move.

Puzzles of the present invention can be created at random or systematically. Further, the puzzles and solutions may be transferred through computer networks such as, but not limited to, LANs, WANs, the Internet and by e-mail. Alternatively, a server computer may be configured to provide client computers with puzzles and solutions upon request via LANs, WANs, and the Internet.

Referring now to the drawings, FIG. 1 illustrates a puzzle game field of play 2 according to the teaching of the present invention, in which the step pattern is similar to that of a Knight in a game of chess, two squares horizontally and one vertically or two vertically and one horizontally. Accordingly, the step from square 1 can go to either square a or square b.

In the electronic version of the game of the present invention, when the cursor is moved to square 1, squares a and b may be highlighted.

If the player decides to move to square b, then the numeral 2 is placed in square b, which is the last square in the step pattern. It will be readily understood that when the game play interface is printed material the term "place" is used herein to mean "write".

The step from square 2 can go to any one of squares c, d, e, f or g. Game play continues until all of the squares in the field of play on the game play interface are filled, as illustrated in FIG. 2, which shows the solution of the puzzle of FIG. 1.

Figure 4:
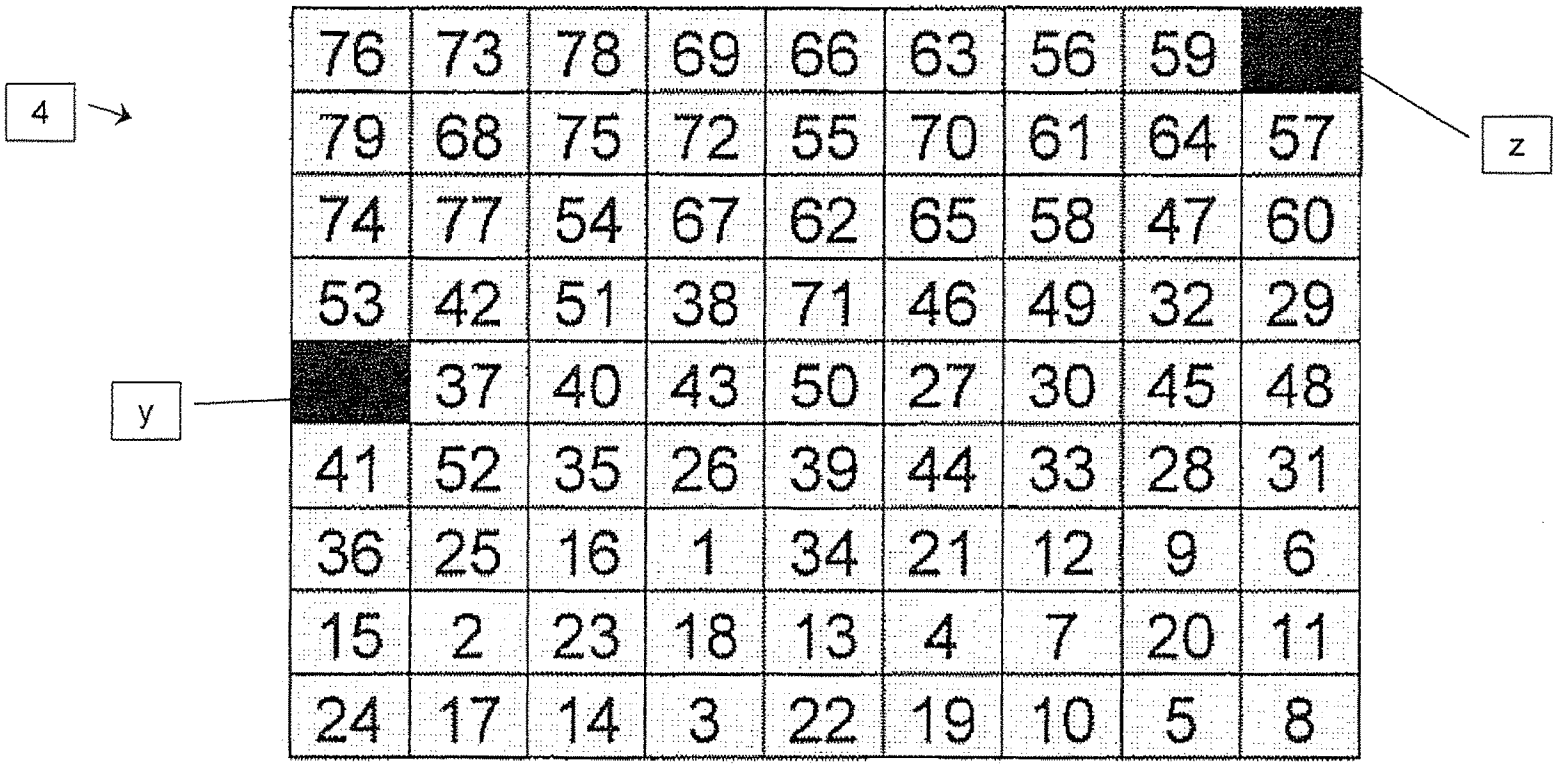
FIG. 4 is the game play interface of FIG. 3 after completion of the game.

It will be readily appreciated that there is only one solution (game path) to the puzzle that begins at square 1 and passes through the squares 16, 18, 22 and 24 in proper sequence. A vast array of different puzzle solutions are possible by changing one or more of the game parameters such as, but not limited to:

1) The staring point, the position of square 1;
2) The end point, the position of square 25 in the example of FIGS. 1 and 2;
3) The placement of any intermediate place-indicators, such as numerals 16, 18, 22 and 24 in the example of FIGS. 1 and 2; and
4) The size of the field of play as illustrated in FIGS. 3 and 4.

It should be noted that, although the solution will show a sequential path of steps from square 1 to the end, which is number 25 in the case of the game of FIGS. 1 and 2, the puzzle need not be solved as a continuous sequential path of steps. That is to say, a player may choose to find to location of intermediate squares using the other numerals that are indicated on the field of play at the beginning of the puzzle, such as squares 16, 18, 22 and 24 in FIG. 1. Therefore, a player may choose, for example, to solve the puzzle along the path from square 16 to square 18 by placing a numeral 17 in either square e or square h before deciding where to place the numeral 2.

The puzzle of FIGS. 3 and 4 illustrates a variation in size and also illustrates the phenomenon of squares y and z that are not included in the field of play of the puzzle shown on the game play interface. Here, squares y and z are simply blacked out. However, substantially any mode of indicating that the squares fall outside of the field of play is within the scope of the present invention.

As shown in FIG. 3, squares 1 and 2 are already indicated on the game play interface, therefore, the player needs to decide where to place the numeral 3 along the path to square 4. Due to the location of already filled squares, the only choice for placement of numeral 3 is in square w. The solution to the puzzle is shown in FIG. 4.

Preferably, the number of blocked squares is low, less than 20% and preferably not more than 7% of all squares on the game play interface.

FIG. 5 illustrates a puzzle game field of play 200 according to the teaching of the present invention, in which the relationship between associated positions 202 on the field of play 200 upon which numerals are to be placed is not a grid per se and the associated positions 202 are hexagons, as mentioned above. The step pattern is to a next associated position along a predetermined game path. As in the embodiments of FIGS. 1-4, the solution to the puzzle is achieved by the placement of all place-indicators between the starting point and the end point as a sequential series of steps.

FIG. 6 illustrates a puzzle game field of play 300 according to the teaching of the present invention, in which the relationship between associated positions 302 on the field of play 300 upon which numerals are to be placed is not a grid per se and the associated positions 302 are circles, as mentioned above. The step pattern is to a next associated position along a predetermined game path. As in the embodiments of FIGS. 1-4, the solution to the puzzle is achieved by the placement of all place-indicators between the starting point and the end point as a sequential series of steps.

It will be appreciated that the above descriptions are intended only to serve as examples and that many other embodiments are possible within the spirit and the scope of the present invention.

What is claimed is:

1. A method of solving a puzzle game, the method comprising:

(a) presenting to a user, on an electronic display, a game interface having at least:
  (i) a field of play having associated positions and predetermined game path, that is unknown to the user, upon which a plurality of sequential place-indicators are placed during game play such that said game path includes all associated positions on said field of play between a starting point of said game path and an end point of said game path, an association of said associated positions being substantially any relationship between two said associated positions on said field of play, including non-horizontal and non-vertical relationships;
  (ii) at least three said place-indicators displayed on said field of play as pre-placed givens in a solution to the puzzle game; such that said field of play is initially displayed on said electronic display having a plurality of empty associated position;

(b) placing a remainder of said sequential place-indicators, by use of an input device associated with said electronic display, on said empty associated positions so as to represent a series of sequential steps from said starting point, along said game path, to said end point;

wherein each step of said series of steps has a predetermined step pattern and each said place-indicator is placed on said field of play at an end of a respective said step, and (c) solving the puzzle by placing all place-indicators on all empty associated positions between said starting point and said end point such that said electronic display displays a place indicator on all associated positions within said field of play and all associated positions are included in said game path.

2. The method of claim 1, wherein a relationship between said associated positions on said field of play is implemented as a grid.

3. The method of claim 1, wherein said electronic display is implemented as part of one of the electronic devices from a list that includes, personal computers both desktop and laptop, game consoles, cellular phones, PDAs, TV set, and handheld electronic game platforms.

4. The method of claim 3, wherein providing said field of play includes generating said field of play using a computer program installed on said electronic device.

5. The method of claim 3, wherein providing said field of play includes transferring said field of play and said solution through at least one computer network from a list includes: LANs, WANs, the Internet and by e-mail.

6. The method of claim 1, wherein said input device is implemented as at least one from a list that includes keyboards, a mouse, game pads, joysticks and touch screens.

* * * * *